United States Patent [19]

Goodnight

[11] 4,137,534

[45] Jan. 30, 1979

[54] VERTICAL ANTENNA WITH LOW ANGLE OF RADIATION

[76] Inventor: Roy G. Goodnight, 440 Columbia Blvd., Deer Island, Oreg. 97051

[21] Appl. No.: 800,969

[22] Filed: May 26, 1977

[51] Int. Cl.[2] ..... H01Q 9/16

[52] U.S. Cl. ..... 343/752; 343/895

[58] Field of Search ..... 343/711-715, 343/749, 750, 752, 751, 895

[56] References Cited

U.S. PATENT DOCUMENTS

| | | | |
|---|---|---|---|
| 3,176,298 | 3/1965 | Nettles | 343/749 |
| 3,179,941 | 4/1965 | Harris et al. | 343/723 |

*Primary Examiner*—Alfred E. Smith
*Assistant Examiner*—David K. Moore
*Attorney, Agent, or Firm*—Klarquist, Sparkman, Campbell, Leigh, Hall & Whinston

[57] ABSTRACT

A vertical antenna comprises a substantially vertical conductor supported on an insulating rod and wound tightly at the top to provide a top loading coil. A capacitive plate is conductively attached to the antenna conductor between the top loading coil, and a connecting adapter located at the lower end of the insulating rod and to which the antenna conductor is joined. An additional radiating coil is wound over the lower portion of the antenna, including the capacitive plate, while being insulated therefrom.

4 Claims, 3 Drawing Figures

VERTICAL ANTENNA WITH LOW ANGLE OF RADIATION

BACKGROUND OF THE INVENTION

The present invention relates to a mobile antenna for communications purposes, and particularly to such an antenna having improved radiation properties.

Vertical antennas are frequently employed on vehicles for both transmitting and receiving purposes, e.g., as an antenna for "citizens-band" communications equipment. Many forms of transmitting and receiving antennas have been proposed, but they frequently suffer from ineffective radiation patterns, difficulty in loading, or unwieldiness and expense resulting from efforts to increase the antenna's effectiveness. A vertical antenna, mounted above a ground plane of a vehicle, may have an input impedence on the order of 18 ohms, which is less than the usual coaxial cable output from the transmitter-receiver. Such an antenna will have a radiation pattern, primarily in the horizontal direction, but appears to waste considerable radiation in directions not of greatest advantage in groundwave, point-to-point communication.

SUMMARY OF THE INVENTION

The antenna according to the present invention is formed upon an insulating rod or the like, including a vertical antenna wire section and a top loading coil at the top of the rod. A lower radiating coil is wound over the antenna wire between the top loading coil and the lower, mounting end of the antenna, and is capacitively coupled to the antenna wire. Preferably, the antenna wire is provided with a capacitive sleeve or plate forming one plate of a capacitor for coupling energy to the surrounding coil. It is found that the resulting antenna produces a lower, more horizontal overall radiation pattern which is believed attributable to two radiation lobes: one due to the vertical antenna and a second due to the capacitively coupled coil. Moreover, the input impedance of the antenna seems to be advantageously affected, i.e., raised by the addition of the lower coil, rendering the drive thereof by conventional transmitting equipment more easily accomplished.

It is therefore an object of the present invention to provide an improved vertical antenna for use with citizens-band communications equipment or the like adapted to have a lower and more effective radiation pattern.

It is another object of the present invention to provide an improved vertical antenna for communications equipment having a higher input impedence.

It is a further object of the present invention to provide an improved vertical antenna of economical construction and convenient size adapting the same for ready mounting on a vehicle for mobile use.

The subject matter which I regard as my invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

DETAILED DESCRIPTION

Figure 1:
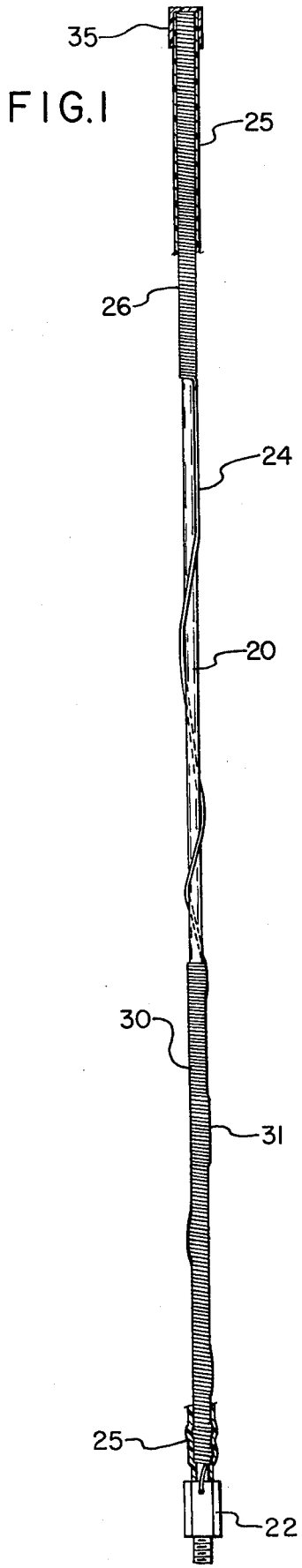
FIG. 1 is a side view of a vertical antenna according to the present invention.
Figure 2:
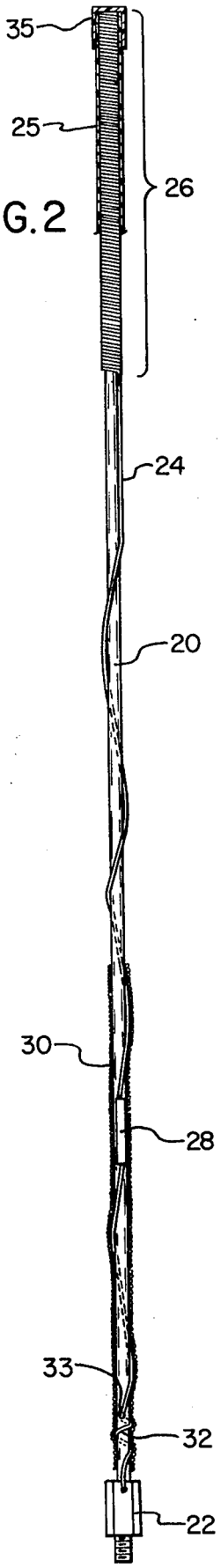
FIG. 2 is a side view of the same antenna, being partially broken away in cross-section to reveal its construction.

Referring to the drawings, the antenna is supported on a "Glastic" insulating rod 20 which is epoxied to a brass adapter threaded fitting 22 at its lower end for connecting to a matching, female threaded support member mounted on a vehicle or the like. Suitably such support member would include a support spring (not shown). A coaxial cable, e.g., a standard 52 ohm coaxial cable is connected in the usual manner to the antenna mounting and through such mounting to the adapter fitting 22. The coaxial cable, of course, connects to the electronic equipment and is utilized alternatively to provide RF energy to the antenna, and receive RF energy from the antenna.

The rod 20 is suitably approximately ¼" in diameter and supports an antenna conductor 24 thereover which is suitably 20 gauge insulated wire making an electrical connection with adapter fitting 22 at its lower end. The wire may be insulated by being provided with an enamel coating. At the upper end of rod 20, the wire 24 is tightly wound to provide an upper loading coil 26. The purpose of this loading coil is primarily to reduce the overall height of the antenna. For example, in the 27 megahertz citizens band, a quarter wave antenna would be approximately 108" long, while the present overall antenna, from tip-to-tip including the adapter fitting 22, is 48" long. The antenna conductor 24 between loading coil 26 and adapter fitting 22 is nearly vertical, but suitably gently spirals around the rod 20, providing an overall helical configuration. At the lower end, the conductor 24 is secured through a horizontal hole 33 in the lower end of the rod and then is wrapped tightly for two or three turns before being soldered to the adapter fitting 22. Thus a lower coil 32 is formed.

Figure 3:
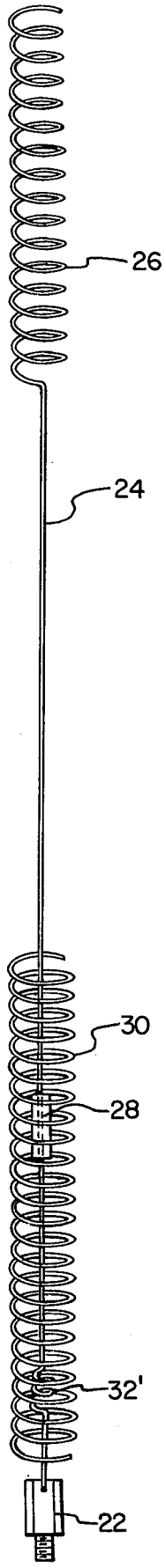
FIG. 3 is a schematic representation of the same antenna.

About two-thirds of the way down the rod, a copper sleeve or plate 28 is connected to the antenna conductor 24. This sleeve or plate is suitably approximately 3" long, and about 1/16 to ⅛" wide and wraps concavely partly around the rod. The sleeve or plate 28 is connected to the antenna wire 24 at the top of the plate as by soldering. Around the lower portion of the antenna rod is wrapped a second coil 30, also formed of insulated wire, suitably 16 gauge enamel covered wire which is normally not physically connected to the antenna wire 24, nor to the plate 28 nor adapter 22. The coil 30 is capacitively coupled to the inner conductor by way of the sleeve 28, from which it is insulated. FIG. 3 shows in semi-schematic fashion the manner in which the coil 30 surrounds the antenna conductor 24 and the sleeve 28. In FIG. 1, it is seen the outer coil 30 bulges slightly at 31 in the vicinity of sleeve 28.

While the theoretical considerations for the antenna's operation are not completely understood, the addition of coil 30 and sleeve 28 appears to produce a lower overall radiation pattern than would a conventional vertical or top loaded vertical antenna. Thus, the antenna according to the present invention appears to produce a pair of primarily horizontally directed side lobes of radiation which strengthen the horizontal RF field, i.e., principally in the direction of another citizens-band transmitter-receiver. It is believed the capacitively coupled coil 30 radiates as an additional or radiating element for strengthening or desirably altering the horizontal radiation pattern provided. It is also noted some inductive effect between the coil 30 and the inner conductor 24 may occur, particularly in the region of lower coil 32 (indicated at 32' in FIG. 3). Inductive coupling may also have some effect in transferring energy to the coil 30, but this effect is believed less significant than that produced by capacitive coupling from sleeve 28.

The additional coil 30 also appears to result in a raising of the input impedance of the antenna presented at adapter fitting 22. Therefore, instead of presenting an impedence of 18 ohms, this impedence appears to be nearer the approximately 50 ohms characteristic of usual coaxial cable employed for connecting an antenna to a transmitter-receiver. Thus, higher impedance therefore results in a better impedence match and easier loading properties for the antenna of the present invention. The impedance is substantially resistive and consequently enables improved energy transfer between the transmitter-receiver and the antenna.

The entire antenna is encased in a heat-shrinkable plastic insulating tubing 25 for protection thereof. The covering is only shown in the drawings at the ends of the antenna for convenience of illustration, but it is understood it covers the remainder of the antenna up to the adapter fitting 22. Many suitable insulating materials are available. A rubber cap 35 protects the upper end of the antenna.

Although not to be taken in a limiting sense, the following exemplary dimensions are given for the antenna according to the present invention for operation at approximately 27 megahertz. The top loading coil 26 extended downwardly from the top of the antenna for a distance of approximately 11 3/16". The overall length of the antenna including a 2½" adapter fitting length is 48". The measurement from the threaded tip end of adaptor fitting 22 to the top of coil 30 is 22", with coil 30 being formed of approximately 31 feet of 16 gauge insulated (e.g. enameled) wire. The distance from the threaded tip end of adapter fitting 22 to the top of sleeve 28 is suitably 16", or approximately one-third the distance up the antenna structure. Measurements will vary slightly from model to model, depending upon the amount top loading utilized, etc. However, the approximate proportions are maintained, e.g., the copper sleeve 28 being located approximately one-third the distance up the antenna and having coil 30 wound thereover.

While I have shown and described a preferred embodiment of my invention, it will be apparent to those skilled in the art that many changes and modifications may be made without departing from my invention in its broader aspects. I therefore intend the appended claims to cover all such changes and modifications as fall within the true spirit and scope of my invention.

I claim:

1. A vertical antenna comprising:

a substantially vertical continuous conductor having an effective length of substantially an electrical quarterwave at the antenna's operating frequency, said conductor including a top loading coil, and a lower, radiating coil wound over said vertical conductor and insulated therefrom, said coil covering not more than approximately half the length of said antenna, said lower radiating coil being located below the position of said top loading coil said conductor having a capacitive plate means connected thereto and located within said lower coil for providing capacitive coupling between said conductor and said lower coil.

2. A vertical antenna comprising:

an insulating support rod provided with a connecting adapter at the lower end thereof for mounting of said antenna on a vehicle or the like, an antenna conductor supported along said insulating rod and connected at its lower end to said adapter, said conductor being wound relatively tightly around said insulating rod, starting from a point spaced from the end of the insulating rod remote from said adapter and extending approximately to the end of said insulating rod remote from said adapter, to provide a top loading coil, a lower coil wound over said conductor toward the lower end of said rod in spaced relation from said top loading coil and located closer to said adapter than to said top loading coil, said lower coil being insulated from said conductor and means capacitively coupling the lower coil to said conductor.

3. The antenna according to claim 2 wherein said means capacitively coupling the lower coil to said conductor comprises a capacitive plate connected to said conductor and disposed within said lower coil.

4. The antenna according to claim 2 wherein said conductor adjacent said adapter is relatively tightly wound within said lower coil.

* * * * *